US009645594B2

(12) United States Patent
Petenyi

(10) Patent No.: US 9,645,594 B2
(45) Date of Patent: May 9, 2017

(54) VOLTAGE REGULATOR WITH DROPOUT DETECTOR AND BIAS CURRENT LIMITER AND ASSOCIATED METHODS

(71) Applicant: STMICROELECTRONICS DESIGN AND APPLICATION S.R.O., Prague (CZ)

(72) Inventor: Sandor Petenyi, Milovice Nad Labem (CZ)

(73) Assignee: STMicroelectronics Design & Application S.R.O., Prague (CZ)

( * ) Notice: Subject to any disclaimer, the term of this patent is extended or adjusted under 35 U.S.C. 154(b) by 0 days.

(21) Appl. No.: 14/881,498

(22) Filed: Oct. 13, 2015

(65) Prior Publication Data

US 2017/0102724 A1 Apr. 13, 2017

(51) Int. Cl.
*G05F 1/565* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/565; G05F 1/575
See application file for complete search history.

(56) References Cited

U.S. PATENT DOCUMENTS 5,410,241 A * 4/1995 Cecil ..... G05F 3/30 323/312
2014/0184182 A1* 7/2014 Yajima ..... G05F 1/573 323/273
2015/0061621 A1 3/2015 Pons

* cited by examiner

*Primary Examiner* — Gary L Laxton
(74) *Attorney, Agent, or Firm* — Slater Matsil, LLP

(57) ABSTRACT

A voltage regulator includes an input terminal to receive an input voltage, an output terminal to supply an output voltage, a power transistor, a differential amplifier, a driver, a dropout detector and a bias current limiter. The differential amplifier provides a drive signal based on a difference between a voltage reference and a feedback signal corresponding to the output voltage. The driver includes an impedance device, and a driver transistor that receives the drive signal so as to vary a bias current to a control terminal of the power transistor. The dropout detector and the bias current limiter is coupled to the input terminal, the impedance device, and the output terminal and includes first and second transistors coupled together, and a bias current generator coupled to the second transistor.

33 Claims, 7 Drawing Sheets

VOLTAGE REGULATOR WITH DROPOUT DETECTOR AND BIAS CURRENT LIMITER AND ASSOCIATED METHODS

TECHNICAL FIELD

The present invention relates to the field of voltage regulators, and more particularly, to current consumption control of a voltage regulator operating in a dropout mode.

BACKGROUND

Voltage regulators keep the output voltage regulated even if a difference between the input voltage and the output voltage is very low (e.g., 100 mV). If the input voltage is sufficiently high, then the output voltage is at a nominal level and the voltage regulator is operating in a closed loop. However, if the input voltage drops, then the voltage regulator starts to operate in an open loop, which is also referred to as the dropout mode.

Current consumption of a voltage regulator can be significant when operating in the dropout mode. An example voltage regulator 10 is illustrated in FIG. 1 and includes an input terminal 12 to receive an input voltage VIN, an output terminal 14 to supply an output voltage VOUT, and a power transistor 20 having a first conduction terminal 22 coupled to the input terminal 12, a second conduction terminal 24 coupled to the output terminal 14, and a control terminal 26.

A differential amplifier 30 has a first input 32 to receive a voltage reference VREF, and a second input 34 to receive a feedback signal VFB corresponding to the output voltage VOUT. An output 36 of the differential amplifier 30 provides a drive signal VDIFF based on a difference between the voltage reference VREF and the feedback signal VFB.

A driver 50 includes an impedance device 52 coupled to the control terminal 26 of the power transistor 20, and a driver transistor 54. The driver transistor 54 has a first conduction terminal 55 coupled to the control terminal 26 of the power transistor 20, and a control terminal 57 receiving the drive signal VDIFF from the differential amplifier 30 so as to vary a bias current IBIAS to the control terminal 26 of the power transistor 20.

Since the output 58 of the driver 50 is coupled to the power transistor 20, a voltage formed across the impedance device 52 represents VGS of the power transistor. As the load current ILOAD of the voltage regulator 10 changes, VGS of the power transistor 20 also changes. The relation between the load current ILOAD and VGS is given by a transfer function of the power transistor 20. The transfer function is valid when the power transistor 20 is operating in the saturation region. This corresponds to the voltage regulator 10 operating in the closed loop. Since the impedance device 52 is operating between the control terminal 26 and the first conduction terminal 22 of the power transistor 20, the bias current IBIAS of the driver 50 depends on the load current ILOAD.

If the difference VDROP between the input voltage VIN and the output voltage VOUT is sufficiently high, the power transistor 20 stays in the saturation region and VGS of the power transistor is relatively low (e.g., below 1 V). This results in a low bias current IBIAS within the driver 50. If the voltage difference VDROP becomes too low so that the voltage regulator 10 is not able to maintain operating in the closed loop, then the power transistor 20 passes to a linear region. This corresponds to the voltage regulator 10 operating in the dropout mode.

In the dropout mode, the dependence between the load current ILOAD and VGS of the power transistor 20 is no longer given by the transfer function of the power transistor, and VGS can reach a very high level. In fact, the driver 50 can pull down the control terminal 26 of the power transistor 20 to near ground GND, and VGS of the power transistor 20 can approach the input voltage VIN. Since the driver 50 operates over VGS of the power transistor 20, the bias current IBIAS can reach a very high level. In the case of VIN=5 V and a resistive load of the driver transistor 54, the bias current IBIAS can be 5 times higher then the bias at the maximum load current ILOAD. This is valid even if the load current ILOAD is 0 when current consumption of the voltage regulator 10 should be minimal.

As an example, if the voltage level of a battery used to power an electronic device starts to discharge, then the voltage regulator 10 within the electronic device passes from operating in the closed loop to operating in the dropout mode. Operating in the dropout mode results in a significant change in the operating point of the voltage regulator 10, especially in the VGS of the power transistor 20, which can increase up to the input voltage VIN.

For the above illustrated voltage regulator 10, the bias current IBIAS in the driver 50 of the power transistor 20 depends on the VGS of the power transistor 20. If the VGS increases in the dropout mode, then the bias current IBIAS increases as well. For a battery powered electronic device, this means that when the battery becomes discharged and the voltage regulator 10 passes to the dropout mode, even more current starts to sink. This is an undesired behavior and can compromise the electronic device operating time or can even threaten battery safety. Consequently, there is a need for controlling current consumption of the voltage regulator 10 when operating in the dropout mode.

SUMMARY

A voltage regulator may include an input terminal, an output terminal, a power transistor, a differential amplifier, a driver, and a dropout detector and bias current limiter. The dropout detector and bias current limiter advantageously limits current consumption when the voltage regulator is operating in the dropout mode.

The input terminal may be configured to receive an input voltage, the output terminal may be configured to supply an output voltage, and the power transistor may have a first conduction terminal coupled to the input terminal, a second conduction terminal coupled to the output terminal, and a control terminal.

The differential amplifier may have a first input to receive a voltage reference, a second input to receive a feedback signal corresponding to the output voltage, and an output to provide a drive signal based on a difference between the voltage reference and the feedback signal.

The driver may comprise an impedance device coupled to the control terminal of the power transistor, and a driver transistor having a first conduction terminal coupled to the control terminal of the power transistor and a control terminal receiving the drive signal from the differential amplifier so as to vary a bias current to the control terminal of the power transistor.

The dropout detector and bias current limiter are coupled to the power transistor and may comprise first and second transistors and a bias current generator. The first transistor may have a first conduction terminal coupled to the input terminal, a second conduction terminal coupled to the impedance device, and a control terminal. The second transistor may have a first conduction terminal coupled to the output terminal, and a second conduction terminal and a control terminal coupled together and coupled to the control terminal of the first transistor. The bias current generator may be coupled to the second conduction terminal of the second transistor. The bias current generator may be configured to generate a second bias current, and the first and second transistors may be configured as a current mirror so that the bias current for the power transistor mirrors the second bias current.

The dropout detector and bias current limiter may further comprise third and fourth transistors coupled between the input terminal and the differential amplifier. More particularly, the third transistor may have a first conduction terminal coupled to the input terminal, a control terminal coupled to the control terminal of the first transistor, and a second conduction terminal. The fourth transistor may have a first conduction terminal coupled to the second conduction terminal of the third transistor, a control terminal coupled to the impedance device and to the control terminal of the power transistor, and a second conduction terminal coupled to the differential amplifier. The voltage regulator may further comprise a current source coupled between the input terminal and the differential amplifier, and also coupled in parallel to the third and fourth transistors. The fourth transistor adaptively biases the differential amplifier.

The voltage regulator may further comprise a resistive divider coupled to the output terminal, and a feedback path coupled between the resistive divider and the second input of the differential amplifier to provide the feedback signal thereto.

The impedance device may be configured to have an impedance so that a voltage across the impedance device corresponds to a voltage across the power transistor. The impedance device may comprise at least one of a resistance, a transistor configured as a diode, and a resistance coupled in series with a transistor configured as a diode.

The voltage regulator may further comprise a reference voltage source coupled to the first input of the differential amplifier providing the reference voltage. The power transistor may comprises a p-channel MOSFET and the driver transistor may comprises an n-channel MOSFET.

Another aspect is directed to a method for operating a voltage regulator as described above. The method comprises detecting the voltage regulator operating in a dropout mode, and limiting a bias current of the driver during the dropout mode.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
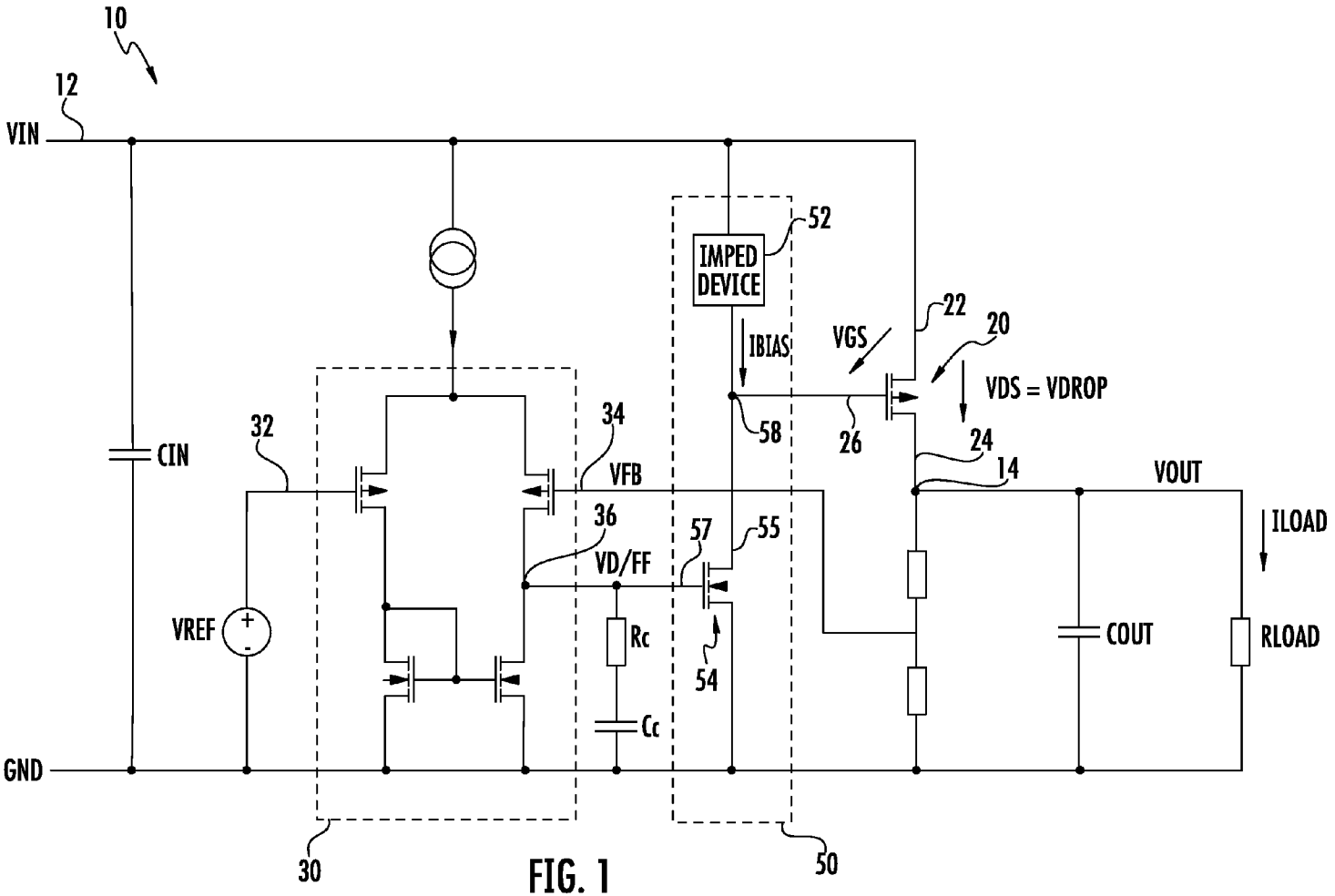
FIG. 1 (PRIOR ART)
FIG. 1 is a block diagram of a voltage regulator in accordance with the prior art.
Figure 2:
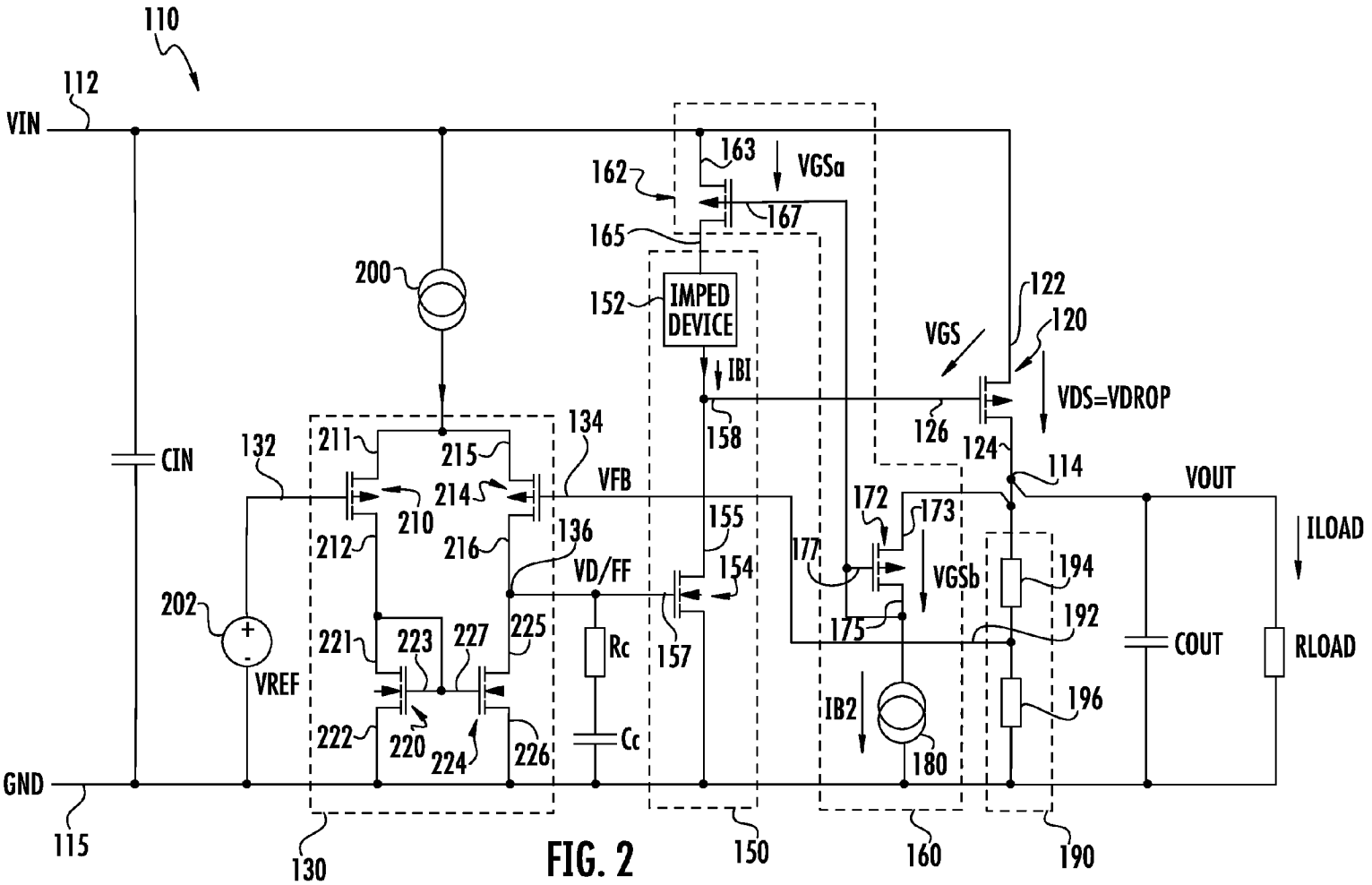
FIG. 2 is a block diagram of a voltage regulator with a dropout detector and bias current limiter in accordance with the present invention.

A voltage regulator 110 with a dropout detector and bias current limiter 160 will be discussed in reference to FIG. 2. As will be explained in detail below, the dropout detector and bias current limiter 160 advantageously limits current consumption when the voltage regulator 160 is operating in the dropout mode.

The illustrated voltage regulator 110 includes an input terminal 112 to receive an input voltage VIN, an output terminal 114 to supply an output voltage VOUT, and a power transistor 120 having a first conduction terminal 122 coupled to the input terminal 112, a second conduction terminal 124 coupled to the output terminal 114, and a control terminal 126.

A differential amplifier 130 has a first input 132 to receive a voltage reference VREF, and a second input 134 to receive a feedback signal VFB corresponding to the output voltage VOUT. An output 136 of the differential amplifier 130 provides a drive signal VDIFF based on a difference between the voltage reference VREF and the feedback signal VFB.

A constant current source 200 is coupled between the input terminal 112 and the differential amplifier 130. The differential amplifier 130 includes a first pair of transistors 210, 214 coupled to a second pair of transistors 220, 224. The first pair of transistors 210, 214 defines the first and second inputs 132, 134 of the differential amplifier 130. The second pair of transistors 220, 224 is configured as a current mirror.

More particularly, the transistor 210 has a first conduction terminal 211 coupled to the constant current source 200, a control terminal forming the first input 132 that is coupled to a voltage reference 202 providing the reference voltage VREF, and a second conduction terminal 212. The transistor 214 has a first conduction terminal 215 coupled to the constant current source 200, a control terminal forming the second input 134 that receives the feedback signal VFB, and a second conduction terminal 216 coupled to the output 136 that provides the drive signal VDIFF.

The transistor 220 has a first conduction terminal 221 coupled to the second conduction terminal 212 of the transistor 210, a control terminal 223, and a second conduction terminal 222 coupled to ground 115. The transistor 224 has a first conduction terminal 225 coupled to the second conduction terminal 216 of the transistor 214, a control terminal 227 coupled to both the first conduction terminal 221 and the control terminal 223 of the transistor 220, and a second conduction terminal 226 coupled to ground 115.

A driver 150 includes an impedance device 152 coupled to the control terminal 126 of the power transistor 120, and a driver transistor 154. The driver transistor 154 is an n-channel MOSFET. The driver transistor 154 has a first conduction terminal 155 coupled to the control terminal 126 of the power transistor 120, and a control terminal 157 receiving the drive signal VDIFF from the differential amplifier 130 so as to vary a bias current IB1 to the control terminal 126 of the power transistor 120.

Since the output 158 of the driver 150 is coupled to the power transistor 120, a voltage formed across the impedance device 152 represents VGS of the power transistor. Configuration of the impedance device 152 depends on the electrical characteristics of the voltage regulator 110, as well as the size of the power transistor 120, as readily appreciated by those skilled in the art.

Figure 3C:
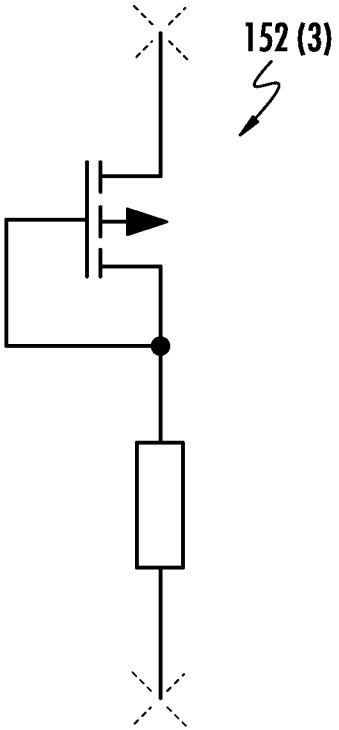
FIGS. 3A, 3B, 3C are schematic diagrams representing different options for the impedance device illustrated in FIG. 2.
Figure 3B:
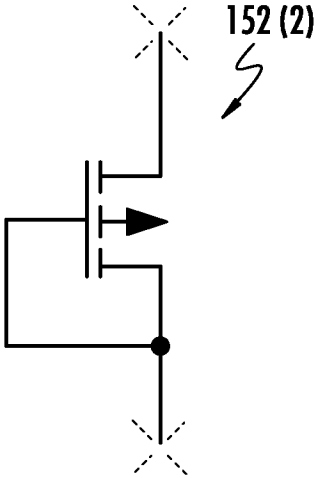
Figure 3A:
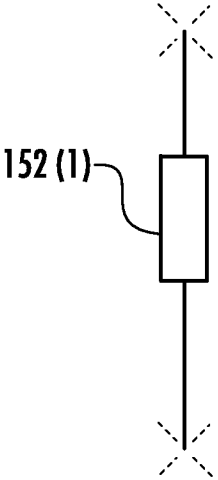

The load device 152 may be a resistance 152(1), a transistor 152(2) connected as a diode, or a combination of the two 152(3), as illustrated in FIG. 3. The respective resistances of these three different configurations of the impedance device 152 are generically referenced as R152. Consequently, the bias current IB1 is based on the following relationship:

$$IB1=VGS/R152$$

The power transistor 120 is a p-channel MOSFET. The VGS of the power transistor 120 is varied by the drain current (i.e., IB1) of the driver transistor 154. VGS is based on the following relationship:

$$VGS=IB1*R152$$

The bias current IB1 is controlled by the output voltage of the differential amplifier 130. This relationship is given by the transconductance of the driver transistor 150, and is defined as follows:

$$IB1=gm*VDIFF$$

A resistive divider 190 is coupled between the output terminal 114 and ground 115 and includes resistors 194, 196 connected together in series. A feedback path 192 is coupled between the resistors 194, 196 and the second input 134 of the differential amplifier 130 to provide the feedback signal VFB. The feedback signal VFB is a scaled replica of the output voltage VOUT. The relationship is given by the following:

$$VFB = VOUT\frac{R196}{R194 + R196}$$

The output voltage VOUT is a scaled replica of the reference voltage VREF provided by the voltage reference 202. The relationship between the reference voltage VREF and the output voltage VOUT is given by the following:

$$VOUT = VREF\frac{R194 + R196}{R196}$$

The differential amplifier 130 assures that the feedback signal VFB equals the voltage reference VREF.

Since the impedance device 152 is operating between the control terminal 126 and the first conduction terminal 122 of the power transistor 120, the bias current IB1 of the driver 150 depends on the load current ILOAD. If the difference between the input voltage VIN and the output voltage VOUT is sufficiently high, the power transistor 120 stays in the saturation region and the VGS of the power transistor 120 is relatively low (e.g., below 1 V). This results in a low bias current IB1 within the driver 150. This corresponds to the voltage regulator 110 operating in the closed loop.

However, if the voltage difference VDROP becomes too low so that the voltage regulator 110 is not able to operate in the closed loop, then the power transistor 120 passes to a linear region. This corresponds to the voltage regulator 110 operating in the dropout mode.

If the VGS increases in the dropout mode, then the bias current IB1 increases as well. This is because the bias current IB1 for the power transistor 120 depends on the VGS of the power transistor 120. For a battery powered electronic device, this means that when the battery becomes discharged and the voltage regulator 110 passes to the dropout mode, even more current starts to sink.

The dropout detector and bias current limiter 160 advantageously limits current consumption when the voltage regulator 160 is operating in the dropout mode. The dropout detector and bias current limiter 160 is coupled to the power transistor 120 and includes a first transistor 162, a second transistor 172 and a bias current generator 180.

The first transistor 162 has a first conduction terminal 163 coupled to the input terminal 112, a second conduction terminal 165 coupled to the impedance device 152, and a control terminal 167. The second transistor 172 has a first conduction terminal 173 coupled to the output terminal 114, a second conduction terminal 175 and a control terminal 177 coupled together and to the control terminal 167 of the first transistor 162. The bias current generator 180 is between the second conduction terminal 175 of the second transistor 172 and ground 115 and provides a second bias current IB2.

The second transistor 172 is biased by the bias current generator 180 so as to define a potential of the control terminal 177 one VGS below the output voltage VOUT. Since the conduction terminals 167, 177 of the first and second transistors 162, 172 are shorted together, the VGS of the first transistor 162 is given by the following:

$$VGS_{162}=VGS_{172}+VDROP$$

This means that higher the difference is between the input voltage VIN and the output voltage VOUT, then the VGS overdrive of the first transistor 162 is higher. The VGS overdrive is an expression and parameter used to specify operation of a transistor in the linear region. If the voltage regulator 110 is operating in a closed loop, then the first transistor 162 is in the linear region. In fact, the first transistor 162 operates as a switch which does not influence the circuit operation.

If the load current ILOAD is zero and the input voltage VIN is below the nominal level of the output voltage VOUT, then the voltage regulator 110 is operating in the dropout mode. In this specific case the VDROP will be zero and the following relationship is provided:

$$VGS_{162}=VGS_{172}$$

This means that the first and second transistors 162, 172 form a current mirror and the bias current IB1 of the driver 150 will be given by the bias current IB2 from the bias current generator 180.

Figure 4:
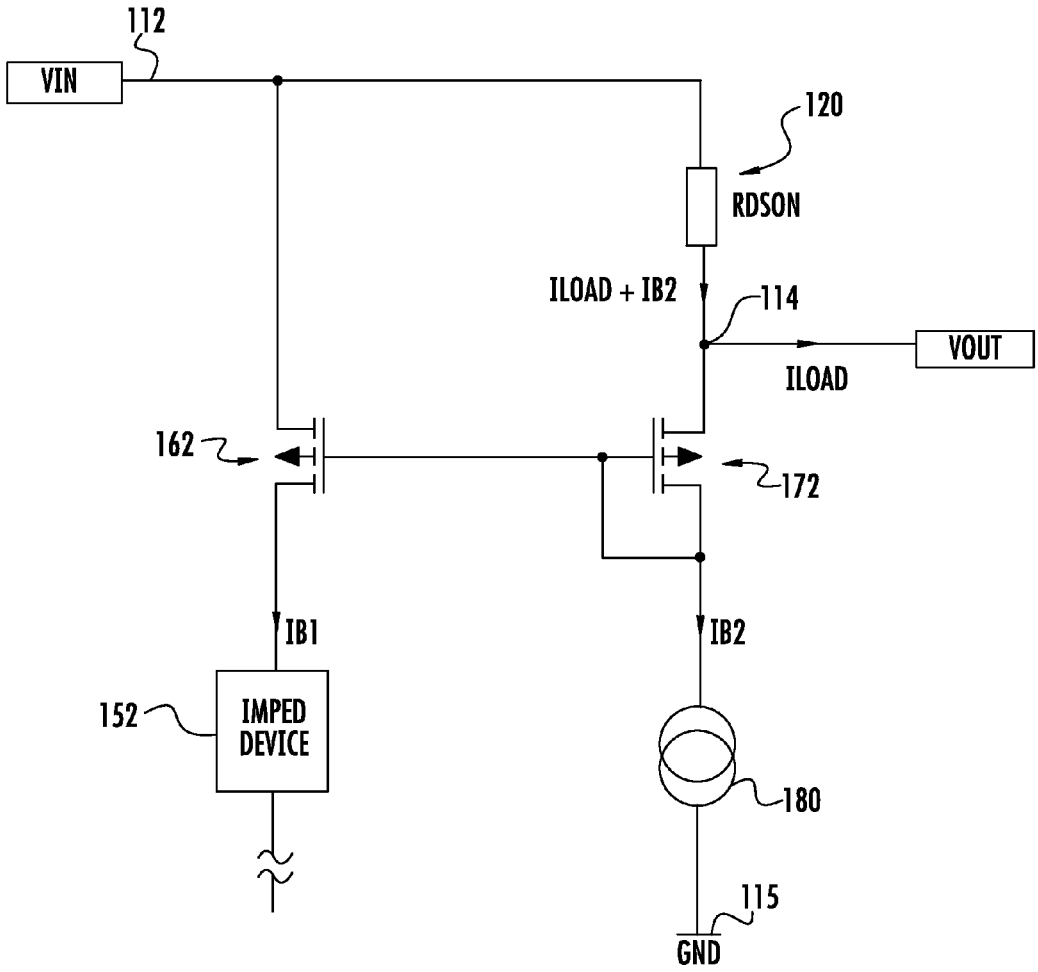
FIG. 4 is a schematic diagram of the dropout detector and bias current limiter and the power transistor illustrated in FIG. 2 when the voltage regulator is operating in the dropout mode.

Operation as a current mirror for reducing current consumption when the voltage regulator 110 is operating in the dropout mode will now be discussed with reference to FIG. 4. In the dropout mode, the power transistor 120 is operating in the linear region and may be represented by a resistor RDSON. The first and second transistors 162, 172 are the same. If ILOAD=0 A then the current through the resistor RDSON is equal to IB2, which can be a few tens of nA, so the voltage drop on resistor RDSON is practically zero. The resistor RDSON may have a value of 1Ω, for example. With a voltage drop of practically zero across the resistor RDSON, this is equivalent to a short, which in turn provides a current mirror. Consequently, the bias current IB1 will be given by the bias current IB2. In other words, the driver 150 is adaptively biased. This is the maximum current which can flow through the driver 150. The bias current IB2 is from the bias current generator 180 which is a constant current generator.

If the voltage regulator 110 is operating in the dropout mode, but the load current ILOAD is not zero, there will be some voltage drop on the resistor RDSON, which is based on the following relationship:

$$VDROP=RDSON*ILOAD$$

Contribution from the bias current IB2 is negligible. The VGS of the first transistor 162 will be higher than the VGS of the second transistor 172. This will cause a certain increase in the bias current IB1. The VGS of the first transistor 162 is given by the following relationship:

$$VGS_{162}=VGS_{172}+VDROP$$

Even though the bias current IB1 will be higher than the bias current IB2, it is still limited.

By proper sizing of first and second transistors 162, 172 and the bias current generator 180 it is possible to find a good compromise between the dropout mode current consumption and loop stability. Loop stability is an important factor for the sizing of the components. When the dropout detector and bias current limiter 160 is starting to limit the bias current IB1 in the driver 150, the impedance conditions of the driver are changing significantly.

Figure 5:
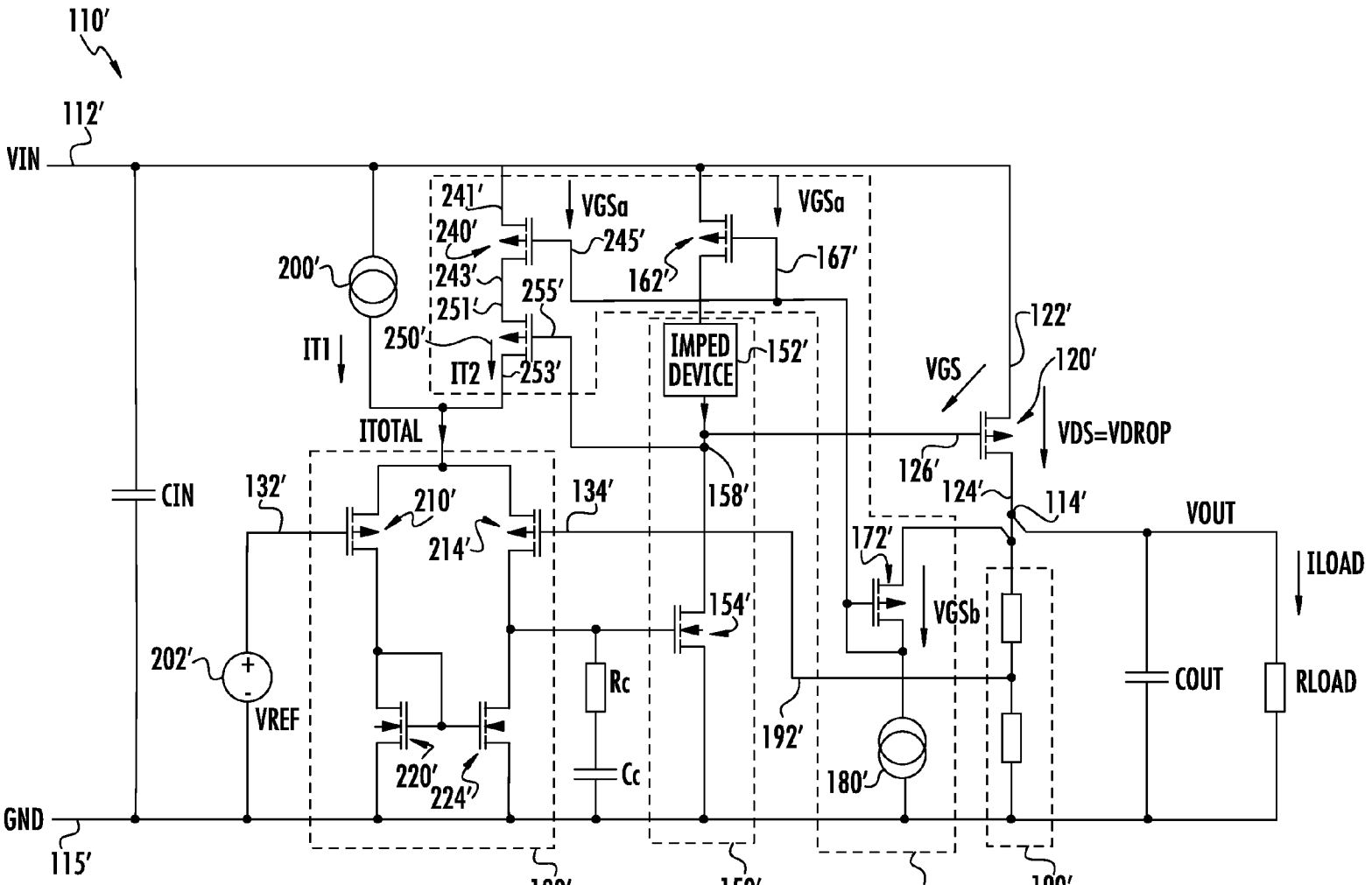
FIG. 5 is a block diagram of another embodiment of the voltage regulator with the dropout detector and bias current limiter illustrated in FIG. 2.

Referring now to FIG. 5, another embodiment of the above described voltage regulator 110' will be discussed. In this embodiment, the dropout detector and bias current limiter 160' further includes third and fourth transistors 240', 250' coupled between the input terminal 112' and the differential amplifier 130'. The fourth transistor 250' adaptively biases the differential amplifier 130'.

More particularly, the third transistor 240' has a first conduction terminal 241' coupled to the input terminal 112', a control terminal 245' coupled to the control terminal 167' of the first transistor 162', and a second conduction terminal 243'. The fourth transistor 250' has a first conduction terminal 251' coupled to the second conduction terminal 243' of the third transistor 240', a control terminal 255' coupled to the impedance device 152' and to the control terminal 126' of the power transistor 120, and a second conduction terminal 253' coupled to the differential amplifier 130'. The current source 200' is coupled in parallel to the third and fourth transistors 240', 250'.

The bias current ITOTAL for the differential amplifier 130' is generated by two current sources. The first current source is provided by the constant current source 200' which provides bias current IT1. The constant current source 200' defines the minimum bias of the differential amplifier 130'. The second current IT2 is provided by the fourth transistor 250' which is configured as a current mirror with the power transistor 120'. The bias current IT2 is a replica of the load current ILOAD but the level is much lower because of a large size ratio between the power transistor 120' and the fourth transistors 250'.

Adaptive biasing the differential amplifier 130' is useful for achieving an improved dynamic performance with a low noise level when the voltage regulator 110' is loaded. When the voltage regulator 110' is operating in the dropout mode, bias boosting in the differential amplifier 130' is not desirable and has no benefit. For this reason, the bias current ITOTAL can be reduced. This is accomplished by the third transistor 240' being coupled to the fourth transistor 250' in the IT2 biasing path. The function of the third transistor 240' is the same as the function of first transistor 162' because they share the same VGS.

Figure 6:
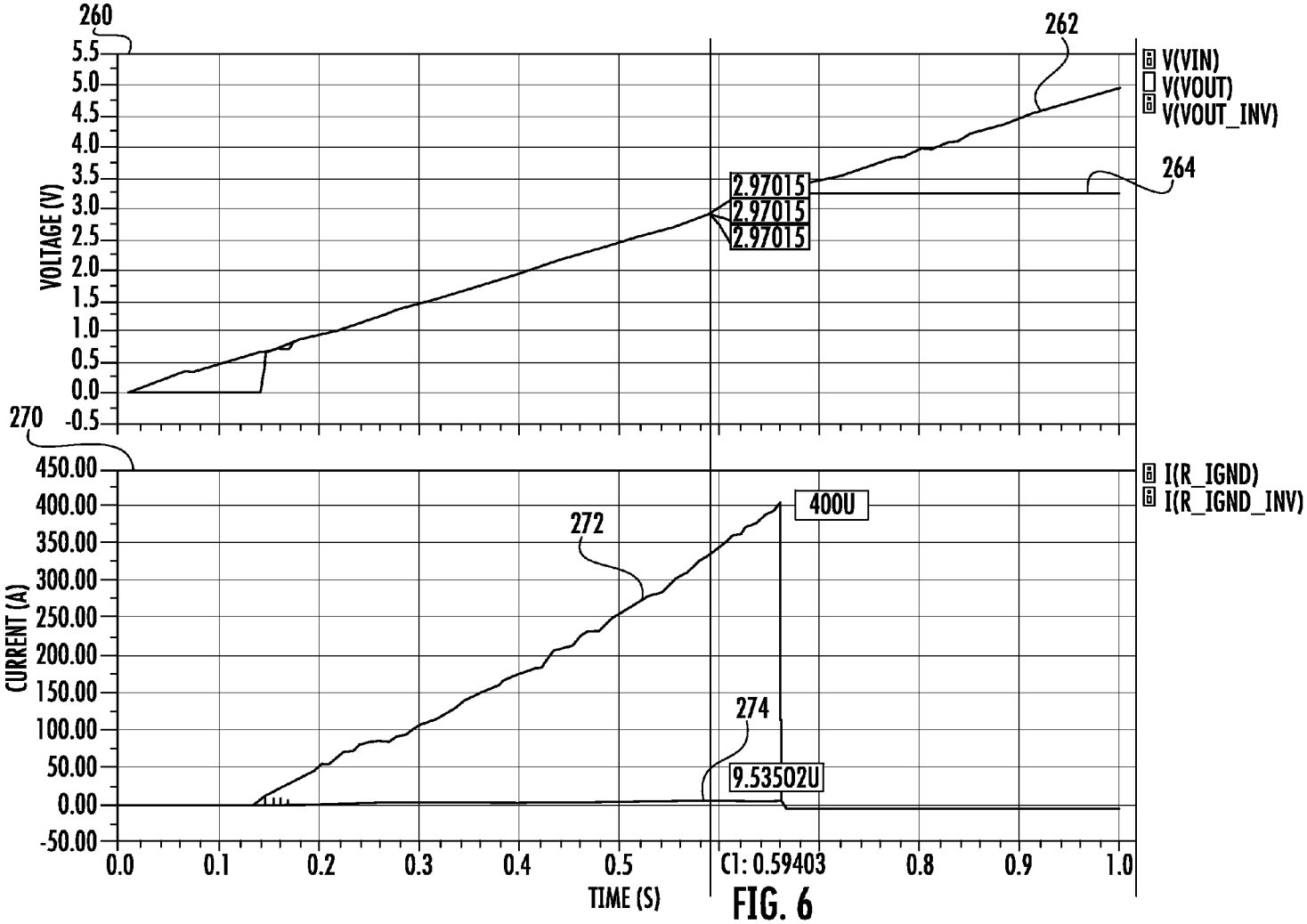
FIG. 6 are graphs illustrating performance characteristics of the voltage regulator illustrated in FIG. 5 with ILOAD=0 and VOUT=3.3 V.
Figure 7:
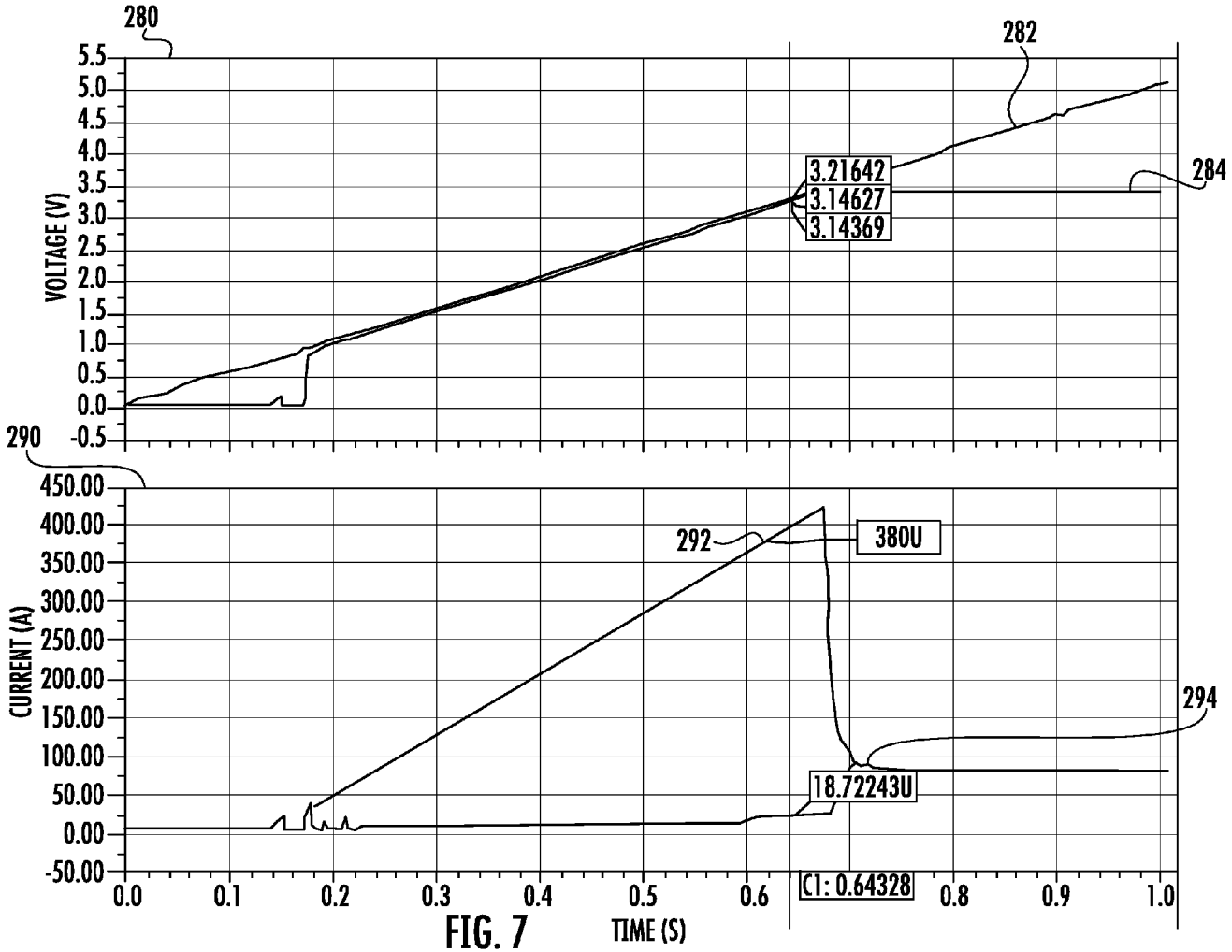
FIG. 7 are graphs illustrating performance characteristics of the voltage regulator illustrated in FIG. 5 with ILOAD=100 mA and VOUT=3.3 V.

Referring now to FIGS. 6 and 7, performance characteristics of the voltage regulator 110' will be discussed. The performance characteristics in FIG. 6 correspond to ILOAD=0 and VOUT=3.3 V for both the prior art voltage regulator 10 and the voltage regulator 110' with the dropout detector and bias current limiter 160'. Voltage characteristics of the voltage regulators 10, 110' are provided in graph 260 and current characteristics of the voltage regulators 10, 110' operating in the dropout mode are provided in graph 270.

Plot 262 corresponds to the input voltage VIN, and plot 264 corresponds to the output voltage VOUT which is the same for both voltage regulators 10, 110'. However, there is a significant difference in the current consumption of the voltage regulators when operating in the dropout mode. Plot 272 corresponds to a current consumption of 400 μA for the prior art voltage regulator 10. Plot 274 corresponds to a current consumption of 9.5 μA for the voltage regulator 110' with the dropout detector and bias current limiter 160'.

The performance characteristics in FIG. 7 correspond to ILOAD=100 mA and VOUT=3.3 V for both the prior art voltage regulator 10 and the voltage regulator 110' with the dropout detector and bias current limiter 160'. Voltage characteristics of the voltage regulators 10, 110' are provided in graph 280 and current characteristics of the voltage regulators 10, 110' operating in the dropout mode are provided in graph 290.

Plot 282 corresponds to the input voltage VIN, and plot 284 corresponds to the output voltage VOUT which is the same for both voltage regulators 10, 110'. However, there is a significant difference in the current consumption of the voltage regulators when operating in the dropout mode. Plot 292 corresponds to a current consumption of 400 μA for the prior art voltage regulator 10. Plot 294 corresponds to a current consumption of 18 μA for the voltage regulator 110' with the dropout detector and bias current limiter 160'.

A method aspect is for operating the above described voltage regulator 110. The voltage regulator 110 comprises an input terminal 112 configured to receive an input voltage VIN; an output terminal 114 configured to supply an output voltage VOUT; a power transistor 120 having a first conduction terminal 122 coupled to the input terminal 112, a second conduction terminal 124 coupled to the output terminal 114, and a control terminal 126; a differential amplifier 130 has a first input 132 to receive a voltage reference VREF, a second input 134 to receive a feedback signal VFB corresponding to the output voltage VOUT, and an output 136 to provide a drive signal VDIFF based on a difference between the voltage reference VREF and the feedback signal VFB; and a driver 150 comprising an impedance device 152 coupled to the control terminal 126 of the power transistor 120, and a driver transistor 154 has a first conduction terminal 155 coupled to the control terminal 126 of the power transistor 120, and a control terminal 157 receiving the drive signal VDIFF from the differential amplifier 130 so as to vary a bias current IB1 to the control terminal 126 of the power transistor 120.

The method comprises detecting the voltage regulator 110 operating in a dropout mode, and limiting a bias current of the driver 150 during the dropout.

The voltage regulator 110 comprises a dropout detector and bias current limiter 160 comprising a first transistor 162 having a first conduction terminal 163 coupled to the input terminal 112, a second conduction terminal 165 coupled to the impedance device 152, and a control terminal 167; a second transistor 172 having a first conduction terminal 173 coupled to the output terminal 114, a second conduction terminal 175 and a control terminal 177 coupled together and to the control terminal 167 of the first transistor 162; and a bias current generator 180 coupled to the second conduction terminal 175 of the second transistor 172. In the method, limiting the current consumption comprises operating the bias current generator 180 to generate a second bias current IB2, and operating the first and second transistors 162, 172 as a current mirror so that the bias current IB1 of the power transistor 120 mirrors the second bias current IB2.

The dropout detector and bias current limiter 160' further comprises a third transistor 240' having a first conduction terminal 241' coupled to the input terminal 112', a control terminal 245' coupled to the control terminal 167' of the first transistor 162', and a second conduction terminal 243'; and a fourth transistor 250' having a first conduction terminal 251' coupled to the second conduction terminal 243' of the third transistor 240', a control terminal 255' coupled to the impedance device 152' and to the control terminal 126' of the power transistor 120', and a second conduction terminal 253' coupled to the differential amplifier 130'. The current source 200' is coupled in parallel to the third and fourth transistors 240', 250'. The method further comprises limiting current from the current source 200' to the differential amplifier 130' during the dropout mode. For discussion purposes, the fourth transistor 250' is illustrated as part of the dropout detector and bias current limiter 160'. Since the purpose of the fourth transistor 250' is to adaptively bias the differential amplifier 130', this transistor may be separated from the dropout detector and bias current limiter 160'. In other words, the fourth transistor 250' may be configured as part of the differential amplifier 130'.

The voltage regulator 110 includes a resistive divider 190 coupled to the output terminal 114; and a feedback path 192 coupled between the resistive divider 190 and the second input 134 of the differential amplifier 130. The method further comprises providing the feedback signal VFB from the resistive divider 190 to the second input 134 of the differential amplifier 130 via the feedback path 192.

The method further comprises selecting an impedance of the impedance device 152 so that a voltage across the impedance device corresponds to a voltage across the power transistor 120.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A voltage regulator comprising:

an input terminal configured to receive an input voltage;

an output terminal configured to supply an output voltage;

a power transistor having a first conduction terminal coupled to the input terminal, a second conduction terminal coupled to the output terminal, and a control terminal;

a differential amplifier having a first input to receive a voltage reference, a second input to receive a feedback signal corresponding to the output voltage, and an output to provide a drive signal based on a difference between the voltage reference and the feedback signal;

a driver comprising an impedance device coupled to the control terminal of said power transistor, and a driver transistor having a first conduction terminal coupled to the control terminal of said power transistor, and a control terminal receiving the drive signal from said differential amplifier so as to vary a bias current to the control terminal of said power transistor; and a dropout detector and bias current limiter coupled to said power transistor, and comprising a first transistor coupled to the input terminal and to said impedance device, a second transistor coupled to the output terminal and to said first transistor, and a bias current generator coupled to said second transistor.

2. The voltage regulator according to claim 1 wherein:

said first transistor has a first conduction terminal coupled to the input terminal, a second conduction terminal coupled to said impedance device, and a control terminal;

said second transistor has a first conduction terminal coupled to the output terminal, a second conduction terminal and a control terminal coupled together and to the control terminal of said first transistor; and said bias current generator is coupled to the second conduction terminal of said second transistor.

3. The voltage regulator according to claim 2 wherein said bias current generator is configured to generate a second bias current; and wherein said first and second transistors are configured as a current mirror so that the bias current for said power transistor mirrors the second bias current.

4. The voltage regulator according to claim 2 wherein the dropout detector and bias current limiter further comprises:

a third transistor having a first conduction terminal coupled to the input terminal, a control terminal coupled to the control terminal of said first transistor, and a second conduction terminal; and a fourth transistor having a first conduction terminal coupled to the second conduction terminal of said third transistor, a control terminal coupled to said impedance device and to the control terminal of said power transistor, and a second conduction terminal coupled to said differential amplifier.

5. The voltage regulator according to claim 4 further comprising a current source coupled between the input terminal and said differential amplifier, and also coupled in parallel to said third and fourth transistors.

6. The voltage regulator according to claim 1 further comprising:

a resistive divider coupled to the output terminal; and a feedback path coupled between said resistive divider and the second input of said differential amplifier to provide the feedback signal thereto.

7. The voltage regulator according to claim 1 wherein said impedance device is configured to have an impedance so that a voltage across said impedance device corresponds to a voltage across said power transistor.

8. The voltage regulator according to claim 7 wherein said impedance device comprises at least one of a resistance, a transistor configured as a diode, and a resistance coupled in series with a transistor configured as a diode.

9. The voltage regulator according to claim 1 further comprising a current source coupled between the input terminal and said differential amplifier.

10. The voltage regulator according to claim 1 further comprising a reference voltage source coupled to the first input of said differential amplifier providing the reference voltage.

11. The voltage regulator according to claim 1 wherein said power transistor comprises a p-channel MOSFET and said driver transistor comprises an n-channel MOSFET.

12. A voltage regulator comprising:

an input terminal configured to receive an input voltage;

an output terminal configured to supply an output voltage;

a power transistor having a first conduction terminal coupled to the input terminal, a second conduction terminal coupled to the output terminal, and a control terminal;

a differential amplifier having a first input to receive a voltage reference, a second input to receive a feedback signal corresponding to the output voltage, and an output to provide a drive signal based on a difference between the voltage reference and the feedback signal;

a reference voltage source coupled to the first input of said differential amplifier providing the reference voltage;

a driver comprising an impedance device coupled to the control terminal of said power transistor, and a driver transistor having a first conduction terminal coupled to the control terminal of said power transistor, and a control terminal receiving the drive signal from said differential amplifier, so as to vary a bias current to the control terminal of said power transistor; and a dropout detector and bias current limiter coupled to said power transistor and comprising a first transistor having a first conduction terminal coupled to the input terminal, a second conduction terminal coupled to said impedance device, and a control terminal, a second transistor having a first conduction terminal coupled to the output terminal, a second conduction terminal and a control terminal coupled together and to the control terminal of said first transistor, and a bias current generator coupled to the second conduction terminal of said second transistor.

13. The voltage regulator according to claim 12 wherein said bias current generator is configured to generate a second bias current; and wherein said first and second transistors are configured as a current mirror so that the bias current for said power transistor mirrors the second bias current.

14. The voltage regulator according to claim 12 further comprising:

a third transistor having a first conduction terminal coupled to the input terminal, a control terminal coupled to the control terminal of said first transistor, and a second conduction terminal; and a fourth transistor having a first conduction terminal coupled to the second conduction terminal of said third transistor, a control terminal coupled to said impedance device and to the control terminal of said power transistor, and a second conduction terminal coupled to said differential amplifier.

15. The voltage regulator according to claim 14 further comprising a current source coupled between the input terminal and said differential amplifier, and also coupled in parallel to said third and fourth transistors.

16. The voltage regulator according to claim 12 further comprising:

a resistive divider coupled to the output terminal; and a feedback path coupled between said resistive divider and the second input of said differential amplifier to provide the feedback signal thereto.

17. The voltage regulator according to claim 12 wherein said impedance device is configured to have an impedance so that a voltage across said impedance device corresponds to a voltage across said power transistor.

18. The voltage regulator according to claim 7 wherein said impedance device comprises at least one of a resistance, a transistor configured as a diode, and a resistance coupled in series with a transistor configured as a diode.

19. The voltage regulator according to claim 12 further comprising a current source coupled between the input terminal and said differential amplifier.

20. The voltage regulator according to claim 12 wherein said power transistor comprises a p-channel MOSFET and said driver transistor comprises an n-channel MOSFET.

21. A method for operating a voltage regulator comprising an input terminal configured to receive an input voltage; an output terminal configured to supply an output voltage; a power transistor having a first conduction terminal coupled to the input terminal, a second conduction terminal coupled to the output terminal, and a control terminal; a differential amplifier having a first input to receive a voltage reference, a second input to receive a feedback signal corresponding to the output voltage, and an output to provide a drive signal based on a difference between the voltage reference and the feedback signal; a driver comprising an impedance device coupled to the control terminal of the power transistor, and a driver transistor having a first conduction terminal coupled to the control terminal of the power transistor, and a control terminal receiving the drive signal from the differential amplifier so as to vary a bias current to the control terminal of the power transistor, and a dropout detector and bias current limiter coupled to the power transistor, with the dropout detector and bias current limiter comprising a first transistor coupled to the input terminal and to the impedance device, a second transistor coupled to the output terminal and to the first transistor, and a bias current generator coupled to the second transistor, the method comprising:

detecting the voltage regulator operating in a dropout mode; and limiting a bias current of the power transistor during the dropout mode.

22. The method according to claim 21 wherein the first transistor has a first conduction terminal coupled to the input terminal, a second conduction terminal coupled to the impedance device, and a control terminal; and the second transistor has a first conduction terminal coupled to the output terminal, a second conduction terminal and a control terminal coupled together and to the control terminal of the first transistor; and the bias current generator is coupled to the second conduction terminal of the second transistor, wherein limiting the current consumption comprises:

operating the bias current generator to generate a second bias current; and operating the first and second transistors as a current mirror so that the bias current for the power transistor mirrors the second bias current.

23. The method according to claim 22 wherein the dropout detector and bias current limiter further comprises a third transistor having a first conduction terminal coupled to the input terminal, a control terminal coupled to the control terminal of the first transistor, and a second conduction terminal; and a fourth transistor having a first conduction terminal coupled to the second conduction terminal of the third transistor, a control terminal coupled to the impedance device and to the control terminal of the power transistor, and a second conduction terminal coupled to the differential amplifier; and wherein the voltage regulator further comprises a current source coupled between the input terminal and the differential amplifier and also coupled in parallel to the third and fourth transistors, the method further comprising:

limiting current from the current source to the differential amplifier during the dropout mode.

24. The method according to claim 21 wherein the voltage regulator further comprises a resistive divider coupled to the output terminal; and a feedback path coupled between the resistive divider and the second input of the differential amplifier, the method further comprising:

providing the feedback signal from the resistive divider to the second input of the differential amplifier via the feedback path.

25. The method according to claim 21 further comprising selecting an impedance of the impedance device so that a voltage across the impedance device corresponds to a voltage across the power transistor.

26. A voltage regulator comprising:

an input terminal configured to receive an input voltage;

an output terminal configured to supply an output voltage;

a power transistor having a first conduction terminal coupled to the input terminal, a second conduction terminal coupled to the output terminal, and a control terminal;

a differential amplifier having a first input to receive a voltage reference, a second input to receive a feedback signal corresponding to the output voltage, and an output to provide a drive signal based on a difference between the voltage reference and the feedback signal;

a driver comprising an impedance device coupled to the control terminal of said power transistor, and a driver transistor having a first conduction terminal coupled to the control terminal of said power transistor, and a control terminal receiving the drive signal from said differential amplifier so as to vary a bias current to the control terminal of said power transistor; and a dropout detector and bias current limiter coupled to said power transistor;

with said impedance device being configured to have an impedance so that a voltage across said impedance device corresponds to a voltage across said power transistor.

27. The voltage regulator according to claim 26 wherein the dropout detector and bias current limiter comprises:

a first transistor having a first conduction terminal coupled to the input terminal, a second conduction terminal coupled to said impedance device, and a control terminal;

a second transistor having a first conduction terminal coupled to the output terminal, a second conduction terminal and a control terminal coupled together and to the control terminal of said first transistor; and a bias current generator coupled to the second conduction terminal of said second transistor.

28. The voltage regulator according to claim 27 wherein said bias current generator is configured to generate a second bias current; and wherein said first and second transistors are configured as a current mirror so that the bias current for said power transistor mirrors the second bias current.

29. The voltage regulator according to claim 27 wherein the dropout detector and bias current limiter further comprises:

a third transistor having a first conduction terminal coupled to the input terminal, a control terminal coupled to the control terminal of said first transistor, and a second conduction terminal; and a fourth transistor having a first conduction terminal coupled to the second conduction terminal of said third transistor, a control terminal coupled to said impedance device and to the control terminal of said power transistor, and a second conduction terminal coupled to said differential amplifier.

30. The voltage regulator according to claim 29 further comprising a current source coupled between the input terminal and said differential amplifier, and also coupled in parallel to said third and fourth transistors.

31. The voltage regulator according to claim 26 further comprising:

a resistive divider coupled to the output terminal; and a feedback path coupled between said resistive divider and the second input of said differential amplifier to provide the feedback signal thereto.

32. The voltage regulator according to claim 26 wherein said impedance device comprises at least one of a resistance, a transistor configured as a diode, and a resistance coupled in series with a transistor configured as a diode.

33. The voltage regulator according to claim 26 further comprising:

a current source coupled between the input terminal and said differential amplifier; and a reference voltage source coupled to the first input of said differential amplifier providing the reference voltage.

* * * * *